United States Patent [19]

Yokoyama

[11] Patent Number: 4,870,804

[45] Date of Patent: Oct. 3, 1989

[54] METHOD OF FORMING A PARALLELEPIPED CONTAINER MADE OF MACHINE-GLAZED PAPER TO BE FILLED WITH LIQUID

[75] Inventor: Yoshimitsu Yokoyama, Ishikawa, Japan

[73] Assignee: Milliken Research Corporation, Spartanburg, S.C.

[21] Appl. No.: 274,852

[22] Filed: Nov. 22, 1988

[51] Int. Cl.[4] ..... B65B 3/02; B65B 43/04; B65B 43/10; B65B 43/32

[52] U.S. Cl. ..... 53/450; 53/456; 53/459; 493/295; 493/300; 493/310

[58] Field of Search ..... 53/450, 456, 459, 469; 493/62, 69, 74, 79, 163, 164, 181, 295, 302, 310, 408

[56] References Cited

U.S. PATENT DOCUMENTS

| | | | |
|---|---|---|---|
| 2,581,491 | 1/1952 | Linstedt | 493/175 |
| 3,400,033 | 9/1968 | Galimberti | 493/309 |
| 3,418,894 | 12/1968 | Jivoin | 493/309 |
| 3,774,509 | 11/1973 | Heinzer | 493/252 |
| 3,795,359 | 3/1974 | Rausing | 229/7 R |
| 3,812,644 | 5/1974 | Kamikawa et al. | 53/29 |
| 3,903,672 | 9/1975 | Goglio | 53/24 |
| 3,910,171 | 10/1975 | Reinhardt et al. | 493/295 |
| 3,988,970 | 11/1976 | Hanson et al. | 493/252 |
| 4,260,446 | 4/1981 | Saul | 493/295 |
| 4,267,957 | 5/1981 | Holmstrom | 229/37 R |
| 4,349,344 | 9/1982 | Evers | 493/11 |
| 4,510,732 | 4/1985 | Lothman | 53/168 |
| 4,530,692 | 7/1985 | Williams | 493/309 |
| 4,546,592 | 10/1985 | Reil | 53/373 |
| 4,578,051 | 3/1986 | Everman | 493/439 |
| 4,614,079 | 9/1986 | Ida et al. | 53/563 |
| 4,759,171 | 7/1988 | Bruveris et al. | 53/563 |
| 4,776,830 | 10/1988 | Fujikawa et al. | 493/133 |

FOREIGN PATENT DOCUMENTS

| | | | |
|---|---|---|---|
| 827581 | 7/1949 | Fed. Rep. of Germany | 493/248 |

*Primary Examiner*—Frederick R. Schmidt
*Assistant Examiner*—William E. Terrell

[57] ABSTRACT

Method of forming a parallelepiped container from a roll of packaging material by sequentially folding and sealing the longitudinal edge of the paper material, forming corners in the web of material, cutting the material into flat tubes, sealing the bottom of the tubes on a mandrel, filling the bottom sealed tube and sealing the top of the filled tube.

1 Claim, 1 Drawing Sheet

METHOD OF FORMING A PARALLELEPIPED CONTAINER MADE OF MACHINE-GLAZED PAPER TO BE FILLED WITH LIQUID

INDUSTRIAL APPLICATION FIELD

This invention concerns a method for making a sealed container to be filled with juice or other liquid characterized by continuously feeding out a machine-glazed paper having a thermoplastic synthetic resin film on it to form parallelepiped containers.

CONVENTIONAL TECHNIQUES

In the (conventional) forming method of parallelepiped containers for filling liquids made of machine-glazed paper, the machine-glazed paper is folded in two in the longitudinal direction, followed by transverse sealing at locations separated from each other by a certain distance; finally, the transverse sealing portions are cut, and individual parallelepiped containers are obtained.

The machine-glazed paper is printed with a prescribed pattern or folding lines before being folded in two.

The obtained pocket-like part can be opened by using a suction unit; it is then transported in a direction perpendicular to the original moving direction and a mandrel is inserted into its opened portion.

For the pocket-like part set on the mandrel, corners are formed on the side surfaces; and at the same time, the end portion of the pocket-like part on the mandrel is folded, and the lugs are fused to seal the top. The container is then removed from the mandrel; liquid is filled into it from the upper opening portion; and then the opening portion is folded and the bottom is sealed.

PROBLEMS TO BE SOLVED BY THIS INVENTION

In the above-mentioned conventional method, when the container is to be set on the mandrel, the container is in the form of a collapsed flat pocket sealed on three sides (the transverse sealed portion and the two folding portions) as a result of the folding process and the transverse press-sealing process. Hence, in order to insert the mandrel into the flat pocket, the opening side must be opened by force to let the mandrel in. For this purpose, a suction opening facility is indispensable. By using this facility, the two overlapped flat surfaces are sucked and dragged away from each other to make an opening.

In addition, as the opening portion is in the direction perpendicular to the original direction of the transporting line, it is thus necessary to make a passive movement towards the mandrel while the opening is made by suction. In this way, the apparatus for implementing the conventional method becomes complicated. In addition, as the transporting direction must be changed, the forming speed is limited.

In consideration of these problems, this invention provides a method of forming a container that can be set on the mandrel easily and at a high speed.

METHODS TO SOLVE THE PROBLEMS

According to this invention, the machine-glazed paper is longitudinally sealed to a tube-like part. With the longitudinal sealing line located vertically in the center back surface of the parallelepiped container to be formed, the central portions of the side surfaces are folded inward; without pressing the folded-in ends, the corner portions are pressed; after the corners are formed, it is returned to the flat shape; by pressing the two side portions, the tube-like part is opened and set on the mandrel; it is then cut to a length required for the container, sealed at the bottom, removed from the mandrel, filled with liquid from the upper opening, and finally sealed at the top.

FUNCTIONS

According to the method of this invention, the machine-glazed paper is longitudinally sealed into a tube shape. As the machine-glazed paper used to form the tube-like part always acts with a recovery force that tends to return to the original flat state, the tube-like part can always be maintained in the opened state. The above-mentioned recovery force is most prominent near the longitudinal sealing portion.

Then, with the longitudinal sealing line located vertically in the center back surface of parallelepiped container, the corners are formed. The central portions on the side surfaces are folded inward to make reliable corners. In addition, the folded-in ends are not pressed, and no edges are formed; hence, the above-mentioned recovery force is not cancelled, and the container still tends to recover the opened state even after the corners are formed. Hence, after corner formation, the past recovers its original tube shape. In addition, as it becomes flat due to the transportation force, the transportation can be carried out smoothly. When the two sides of the flat part are pressed towards the center, the corners appear and an opening is formed due to the joint action of the above-mentioned recovery force. Hence, the mandrel can be inserted easily, and then the necessary length is cut and individual containers are obtained.

After insertion of the mandrel, the process becomes different from the conventional one with respect to corner formation and the sequence of sealing the bottom and top. In this invention, after the bottom sealing stage, the part is removed from the mandrel; then, through the liquid filling stage and the top sealing stage, the desired container filled with liquid is obtained.

1: machine-glazed paper;
2: mandrel;
3: bending roller;
4: heater;
6: folding-in roller;
7: corner-forming roller;
8: pressing rod;
9: cutter;
11: tube-like part.

APPLICATION EXAMPLE

Figure 1:
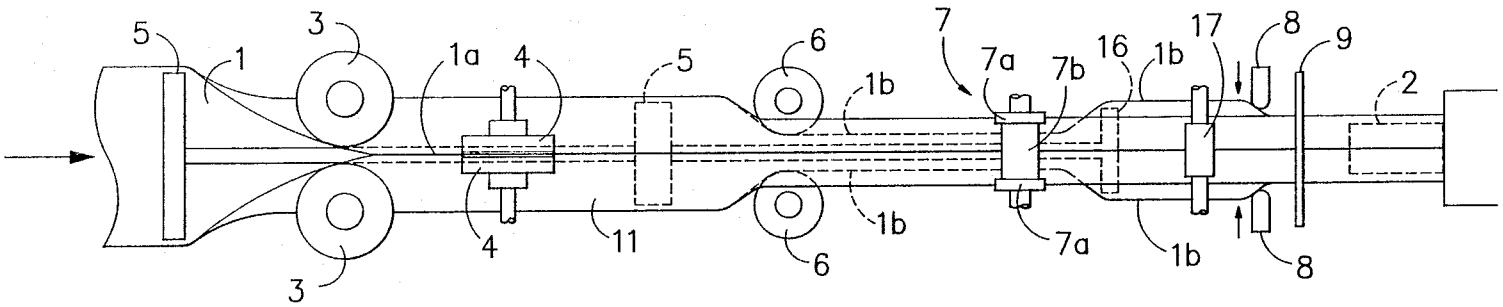
FIG. 1 is a plane diagram illustrating a process for implementing the method of this invention.

The figures illustrate an application example of the method of this invention. FIG. 1 shows a schematic view of the process before mandrel (2) is inserted into (the container made of) machine-glazed paper (1).

Machine-glazed paper (1) supplied by a roll is printed with grid lines; then, two end portions (1*a*), (1*a*) are bent and overlapped by bending rollers (3), (3). The overlapped end portion (1*a*) of bent paper (1) is thermally fused by heater (4), (4), forming a tube-like part (11).

In this case, in order to facilitate formation of tube-like part (11), a ring (5) can be arranged to guide machine-glazed paper (1) and tube-like part (11).

Tube-like part (11) then has the central portions of its side surface formation parts pressed inward. While ends (1*b*), (1*b*) are pressed inward, the part is also pressed by corner-forming rollers (7), (7) to form the edges of the front surface, back surface, and side surfaces.

Corner-forming rollers (7), (7) have two end portions (7*a*), (7*a*) wider and a central portion (7*b*) narrower; hence, end (1*b*) folded by above-mentioned folding-in roller (6) are not pressed. In this way, the formation of folding lines can be prevented.

For tube-like part (11) with corners made of corner-forming rollers (7), (7), as it is originally a flat sheet, there exists a recovery force tending to recover the original state. Although it is temporarily confined by corner-forming rollers (7), (7) to a flat shape, there is still an action trying to open it, so that folded-in ends (1*b*), 1*b*) tend to expand to recover their original shape, and the part proceeds as a flat part to feeding roller (17), etc.

Under the action of the recovery force and guide body (16), tube-like part (11) is transported forward with folded-in ends (1*b*), (1*b*) expanded outward. Acted on by pressing rods (8), (8) located near mandrel (2), the two sides are pressed inward, and the opening becomes rectangular and can be set directly on mandrel (2) located in front of it.

Cutter (9) is arranged in front of mandrel (2). As soon as tube part (11) is set on mandrel (2), tube part (11) is cut, and the portion set on the mandrel is separated as a single part for formation of the container.

Figure 2:
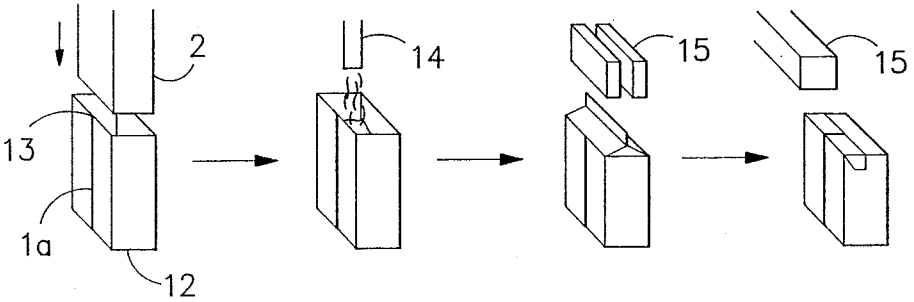
FIG. 2 is a front view of a portion of this process.

FIG. 2 shows the front view of the formation process of the container, in which bottom (12) is sealed on mandrel (2); mandrel (2) is removed while top portion (13) is opened.

After a prescribed amount of juice or other desired liquid is poured through opened top portion (13) using a filling nozzle (14), top portion (13) is folded, and top sealing portion (15) is made by performing transverse sealing and lug sealing. in this way, the container is formed.

EFFECTS OF THE INVENTION

As explained above, according to the method of this invention, the method of forming a container made of machine-glazed paper is different from the conventional method. The insertion direction of the mandrel into the container to be formed is in agreement with the transportation direction; in addition, the opening scheme for insertion is very simple and the forming line can be integrated with a high forming efficiency. Besides, the mechanism can be simplified.

In addition, in the corner formation stage for the side surfaces of the container, the central portions of the side surfaces are folded inward, and the corner portions are pressed; hence, reliable and neat folding lines can be obtained, resulting in a nicely formed container.

I claim:

1. A method of forming a parallelepiped container made of machine-glazed paper to be filled with liquid characterized by a process consisting of the following stages: a longitudinal sealing process in which the two side ends of a piece of machine-glazed paper are overlapped and fused with each other to form a tube-like part; a corner-formation process in which corners are formed with the longitudinal sealing line located vertically on the center back surface of the parallelepiped container, the central portions of the side surfaces are filled inward, and without pressing the folded-in ends, the corner portions are pressed; a transportation stage of the flat tube part after the corner formation stage, an opening stage in which the two sides of the flat tube part are pressed towards the center; an inserting and cutting stage in which the opened tube part is set on a mandrel and the tube part is cut to a length required for the container; a bottom sealing stage on the mandrel; a filling stage in which the mandrel is removed from the container and the liquid is filled into the container through its upper opening portion; and a top sealing process in which the upper opening portion is sealed.

* * * * *